US005966565A

United States Patent [19]

Pozniakas et al.

[11] Patent Number: 5,966,565

[45] Date of Patent: Oct. 12, 1999

[54] COMPOSITE CLEANER SEAL FOR ELECTROPHOTOGRAPHIC MACHINES

[75] Inventors: Robert S. Pozniakas, Rochester; Douglas W. Sass, Ontario, both of N.Y.

[73] Assignee: Xerox Corporation, Stamford, Conn.

[21] Appl. No.: 09/170,675

[22] Filed: Oct. 13, 1998

[51] Int. Cl.[6] ..... G03G 15/08

[52] U.S. Cl. ..... 399/102; 399/105

[58] Field of Search ..... 15/256.5, 256.51; 399/102, 123, 350, 351, 358, 360

[56] References Cited

U.S. PATENT DOCUMENTS

| | | | |
|---|---|---|---|
| 3,992,091 | 11/1976 | Fisher | 399/159 |
| 4,527,887 | 7/1985 | Vineski | 399/102 |
| 5,168,309 | 12/1992 | Adachi et al. . | |
| 5,341,199 | 8/1994 | Thorp et al. . | |
| 5,455,665 | 10/1995 | Baba et al. | 399/358 |

*Primary Examiner*—Matthew S. Smith
*Assistant Examiner*—Hoang Ngo

[57] ABSTRACT

A cleaning seal with a soft cleaning seal tip provides a seal between the cleaning housing and the photoconductive member in an electrophotographic machine. The cleaning seal is made of a relatively stiff material so that the cleaning seal can collect and support the toner removed from the photoconductive member. In the absence of the soft cleaning seal tip, the relatively stiff material of the cleaning seal contacting the photoconductive member excessively scratches the photoconductive member. The soft cleaning seal tip solves this problem by providing a relatively soft surface on the photoconductive member, resulting in fewer scratches on the photoconductive member. The composite cleaning seal provides the sufficient force to remove and support the toner removed from the photoconductive member while cushioning the force of the relatively stiff cleaning seal against the photoconductive member.

13 Claims, 4 Drawing Sheets

COMPOSITE CLEANER SEAL FOR ELECTROPHOTOGRAPHIC MACHINES

This invention relates generally to a seal for a cleaner housing of a printing machine, and more particularly concerns a composite cleaner seal made of a relatively stiff material with a relatively soft material coated on the end which contacts the photoconductive surface in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Although most of the toner forming the image is transferred to the paper during transfer, some toner remains on the photoconductive member. Additionally paper fibers and other debris have a tendency to be attracted to the photoconductive surface. It is essential that the photoconductive surface be clean prior to the formation of the next latent image.

A commercially successful mode of cleaning employs using a brush with soft conductive fiber bristles which have suitable triboelectric characteristics. While the bristles are soft, they are sufficiently firm to remove residual toner particles from the photoconductive member surface. Not all of the toner and debris is removed from the surface by the brush cleaner. A cleaning blade can be used in conjunction with the cleaning brushes to remove the residual toner.

The toner removed from the photoconductive member must be contained so as not to contaminate the rest of the xerographic system. When the cleaning blade is placed after the cleaning brush in the xerographic process, it can be configured so as to seal the cleaner housing. The cleaning blade, however, is not sufficient to contain the toner cloud emitted when the photoconductive member seam disrupts the cleaner blade or when the cleaning brush and cleaning blade are oriented so that gravity causes removed toner to fall past the cleaning blade. In these cases an additional cleaning seal is necessary to contain the removed toner.

It is known to use a soft cleaning seal to contain airborne toner within a electrophotographic cleaning system. In these prior art systems, the cleaning system is located above the photoconductive member and thus the soft cleaning seal does not support the toner removed from the photoconductive member. A relatively stiff cleaning seal has been used to collect and support toner removed from the photoconductive member. For example, when the cleaning system is located in the 3:00 position in the xerographic machine, toner removed by the cleaning brush and cleaning blade falls to the cleaning seal. The cleaning seal supports the fallen toner. However, a relatively stiff cleaning seal results in excessive scratching of the photoconductive surface, especially when there is no toner on the photoconductive surface. The present invention addresses this problem of excessive photoconductive surface scratching by modifying the cleaning seal.

The following disclosures may relate to various aspects of the present invention and may briefly be summarized as follows:

U.S. Pat. No. 5,168,309 issued to Adachi et al. discusses the problem of blade burring, the force tending to turn up the edge of the blade, in the case of a cleaning or charging blade. In order to decrease the frictional coefficient of the portion of the blade contacting the photosensitive member, a sheet layer of low friction coefficient material is attached to the contact side of the blade.

U.S. Pat. No. 5,341,199 issued to Thorp et al. teaches a cleaning housing with a cleaning seal flap and a cleaning blade in contact with a photoreceptor. The cleaning seal is located upstream of the cleaning blade and works with the cleaning blade to seal the cleaning housing.

All of the above references are hereby incorporated by reference.

SUMMARY OF THE INVENTION

In accordance with one aspect of the present invention a cleaning seal in a cleaning station for cleaning toner from an endless photoconductive member in an electrophotographic machine is located after a cleaning blade has removed toner from the photoconductive member. The cleaning seal is supported at a first end by the cleaning housing and sealingly engaged with the photoconductive member at a second end. The cleaning seal is made of a first material, the first material being relatively stiff so that the cleaning seal can support the toner removed from the photoconductive member. A cleaning seal tip is located at the second end of the cleaning seal, the cleaning seal tip is made of a second material which is softer than the first material so that the cleaning seal tip provides a soft cushion between the cleaning seal and the photoconductive member.

Pursuant to another aspect of the present invention, there is provided a cleaning seal in a cleaning station which contacts a photoconductive member thereby sealing the cleaning station. The cleaning seal includes a first cleaning seal portion which supplies sufficient force to support toner removed by the cleaning station and a second cleaning seal portion which contacts the photoconductive member, the second cleaning seal portion being made of a softer material than the first cleaning seal portion.

Pursuant to yet another aspect of the present invention, a method of sealing a cleaning station of an electrophotographic machine having a photoconductive member is disclosed. The method includes locating a relatively stiff cleaning seal having a relatively soft cleaning seal tip in sealing relationship between the cleaning housing and the photoconductive member. The photoconductive member is contacted with the relatively soft cleaning seal tip, wherein fewer scratches result on the photoconductive member than when the relatively soft cleaning seal tip is absent.

The present invention is drawn to a relatively stiff cleaning seal with a relatively soft cleaning seal tip which contacts the photoconductive member in an electrophotographic machine. The cleaning seal is made of relatively stiff material so that the cleaning seal can collect and support the toner removed from the photoconductive member. In the absence of the soft cleaning seal tip, the relatively stiff material of the cleaning seal excessively scratches the photoconductive member: the soft cleaning seal tip on the cleaning seal results in fewer scratches on the photoconductive member.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
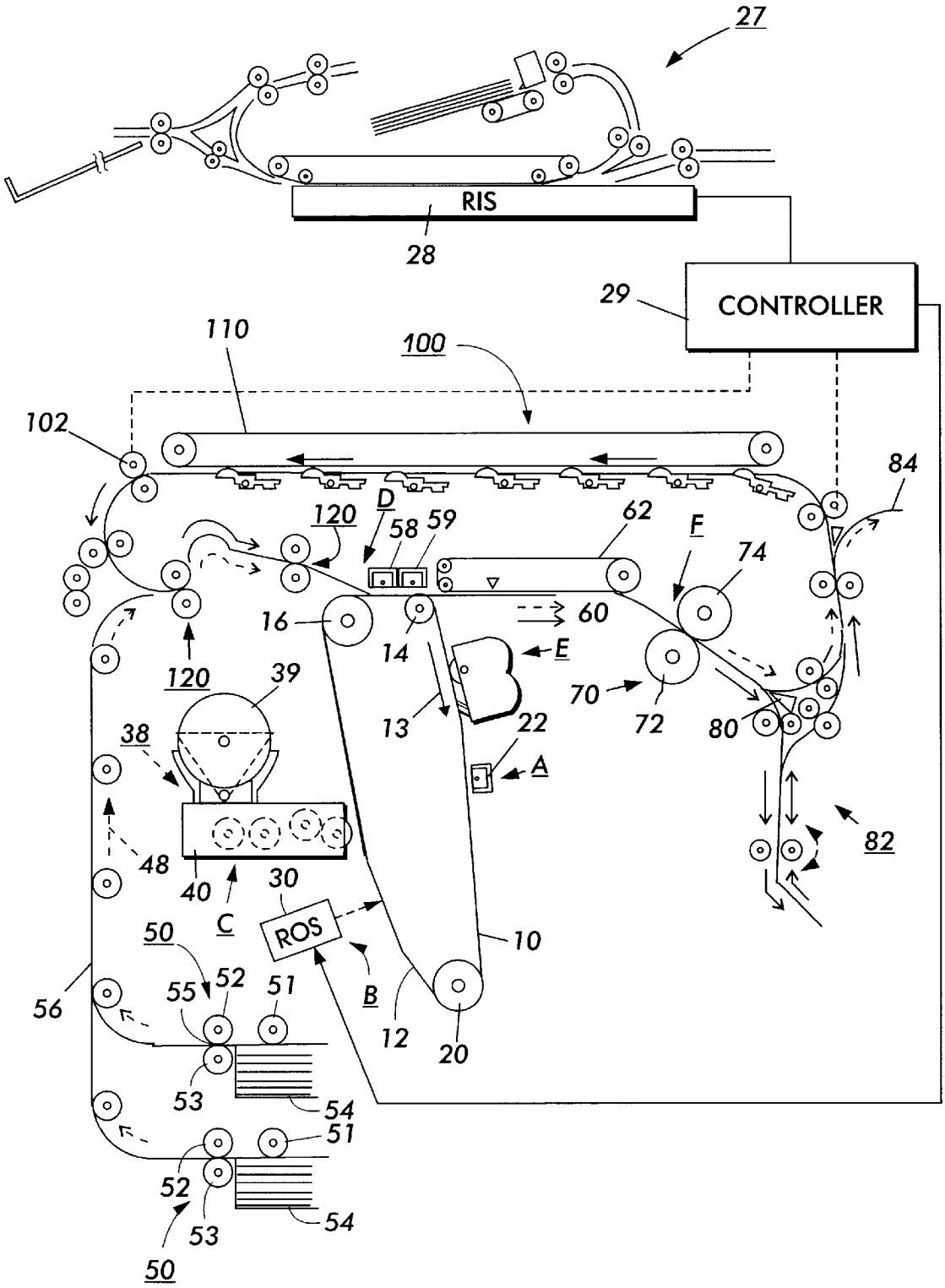
FIG. 1 is a schematic elevational view of a typical electrophotographic printing machine using the composite cleaner seal of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the stalled roll registration device of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
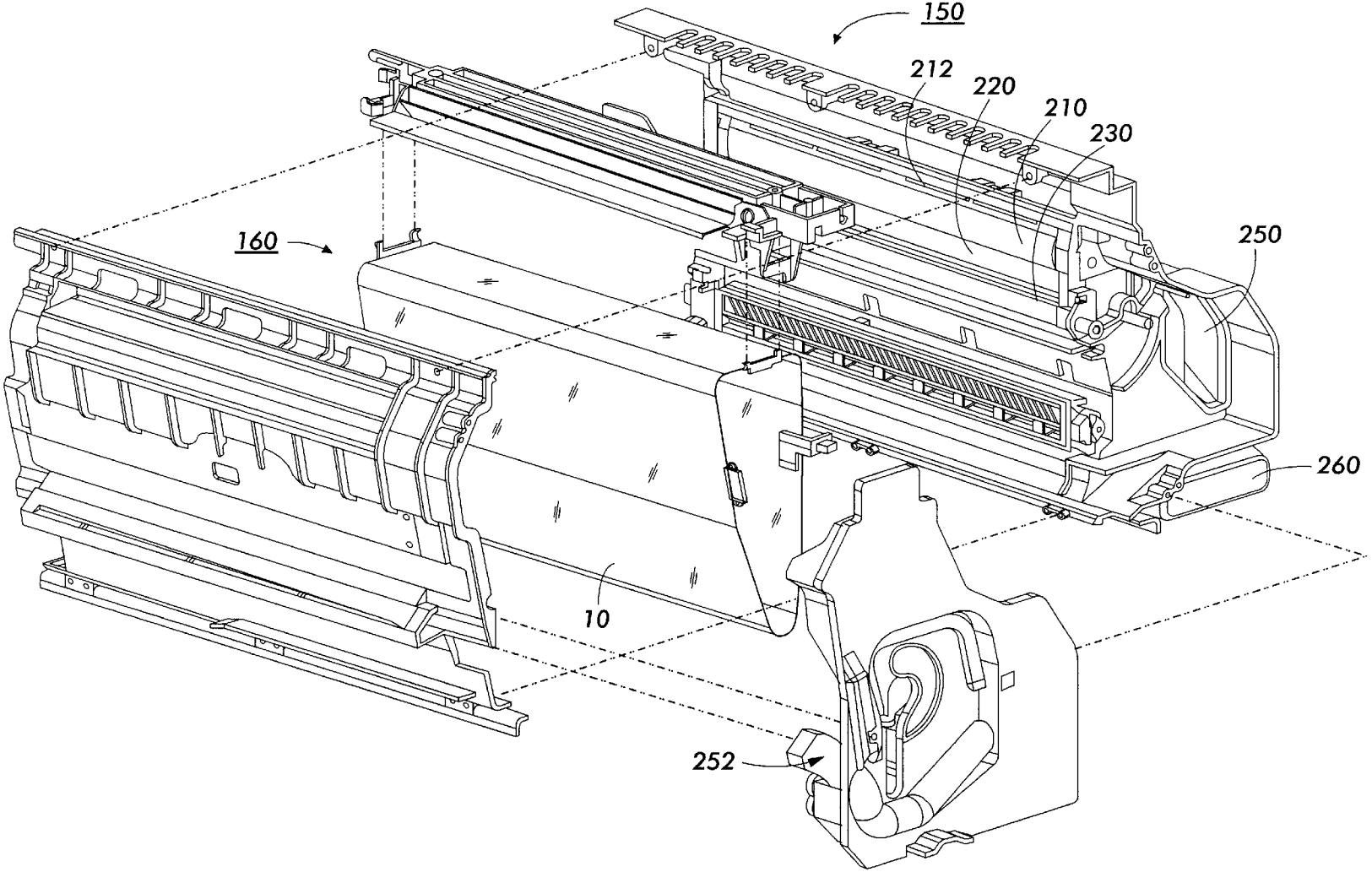
FIG. 2 is a perspective view of one side of a xerographic customer replaceable unit (CRU)

Turning next to FIGS. 2 there is illustrated a perspective view of the xerographic customer replaceable unit (CRU) 150. The xerographic CRU 150 module mounts and locates xerographic subsystems in relationship to the photoreceptor module 160 and xerographic subsystem interfaces.

Cleaning station E includes cleaning housing 200, cleaning brush assembly 210, cleaning blade assembly 220 and cleaning seal assembly 230. The cleaning blade assembly may be automatically engaged and retracted as desired (see FIG. 3). Cleaning brush assembly 210 and cleaning blade assembly 220 remove untransferred toner from photoconductive surface 12. Waste toner and other debris removed from the photoconductive surface 12 are contained in cleaner housing 200 which has waste transport 250 attached thereto. Waste transport 250 transports the toner and other debris to waste bottle 260 for storage. Dirt manifolds 252 and filters within waste transport 250 (not shown) remove airborne toner dirt and contaminants from the moving air before it leaves the CRU.

Figure 3:
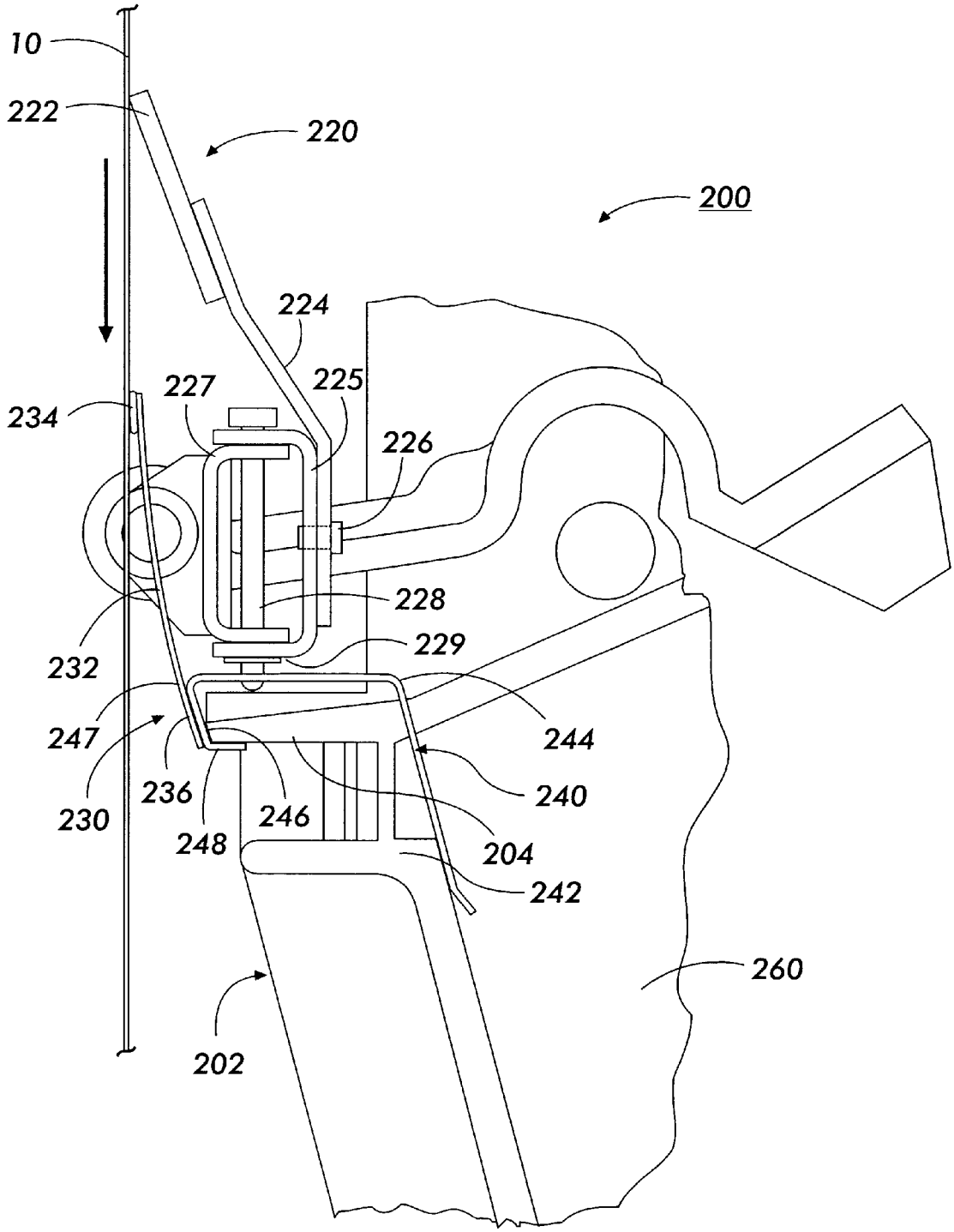
FIG. 3 is a side view of the cleaning blade and cleaning seal in an inoperative position.

FIG. 3 shows a side view of cleaning blade assembly 220 disengaged from photoconductive belt for CRU replacement. Photoconductive member 10 moves away from cleaning blade assembly when the photoconductive member is detensioned to remove the CRU. When operating, photoconductive belt is in the position indicated by dashed line 10' and moves in the direction indicated by the arrow. Cleaning blade assembly 220 is indirectly supported by clamp 240. Clamp 240 is attached to clamp support 204 of cleaning housing 200.

Cleaning blade assembly 220 includes a cleaning blade 222 which is supported by blade support 224. Blade support 224 is attached to U-shaped blade holder 225 with support connector 226. Blade holder 225 is in turn attached to U-shaped blade mount 227 with support pin 228. Support pin 228 has nut 229 at one end and fixes blade holder 225 and blade mount 227 together, locating cleaning blade assembly 220 with respect to the cleaner housing 200.

Cleaning seal assembly 230 includes a cleaning seal 232 having a seal tip 234 and a seal fixed end 236. Seal fixed end 236 is attached to clamp 240. Clamp 240 has clamp sections 242, 244, 246 and 248 which engage clamp support 204 and overlap the flange of waste container 260 to retain and seal waste container to CRU housing 150.

One way to attach seal fixed end 236 to clamp section 246 is by adhesive, but may be attached in any other equivalent manner. Seal tip 234 is free to contact the photoconductive member 10 and remains in contact with photoconductive member is detensioned as shown in FIG. 3. This provides for a sealed cleaner housing when the cleaning blade assembly 220 is disengaged from the photoconductive member 10.

Figure 4:
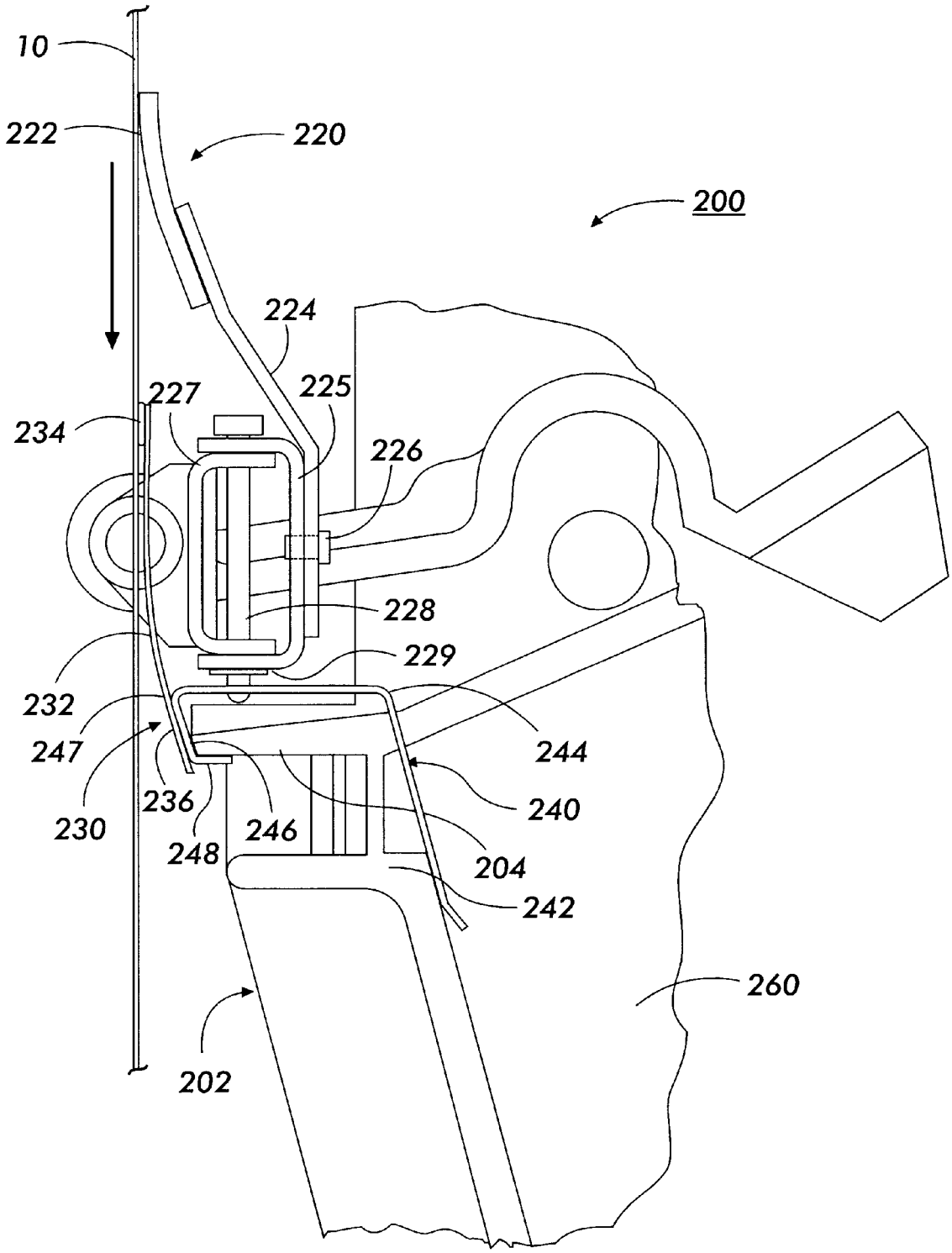
FIG. 4 is a side view of the cleaning blade and cleaning seal in an operative position.

FIG. 4 shows a side view of cleaning blade assembly 220 and cleaning seal assembly 230 in the operative position with cleaning blade 222 and cleaning seal tip 234 contacting photoconductive member 10. As can be seen from this operative position, cleaning seal tip 234 engages photoconductive member 10 with a greater force than shown in FIG. 3 so as to seal cleaning housing 200 from the rest of the electrophotographic machine. The normal force of a cleaning blade is supplied by the relatively stiff material of cleaning seal 232, however the soft compliant material of cleaning seal tip 234 will not scratch the bare photoconductive surface. The conformability of cleaning blade tip 234 also allows for hard debris to indent into it rather than scratching the photoconductive surface.

Cleaning seal 232 may be made of any relatively stiff material, including such materials as Mylar, polyester, steel shim stock, polyimide, or PVC. Seal tip 234 may be made of any relatively soft material, including such materials as urethane or teflon. For example, when 3 mil Mylar is used for cleaning seal 232 and soft 4 mil urethane extending 2 mm from the edge of cleaning seal 232 to form seal tip 234 results in a well-sealed cleaning housing 200 with no significant scratches on the photoconductive surface.

While the invention herein has been described in the context of a black and white printing machine, it will be readily apparent that the device can be utilized in any electrophotographic printing machine to seal a cleaning housing and to prevent damage to a photoconductive surface.

It is, therefore, apparent that there has been provided in accordance with the present invention, composite cleaner seal that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A cleaning station for cleaning toner from an endless photoconductive member in an electrophotographic machine, comprising:

a cleaning housing;

a cleaning blade supported by the cleaning housing;

a cleaning seal, located after the cleaning blade has removed the toner from the photoconductive member, the cleaning seal being supported at a first end by the cleaning housing and sealingly engaged with the photoconductive member at a second end, wherein the cleaning seal is made of a first material, the first material being stiff enough so that the cleaning seal can support the toner removed from the photoconductive member and a cleaning seal tip located at the second end of the cleaning seal, the cleaning seal tip is made of a second material which is softer than the first material so that the cleaning seal tip provides a soft cushion between the cleaning seal and the photoconductive member, wherein the cleaning seal tip extends 1–5 mm from the second end of the cleaning seal.

2. The cleaning station as claimed in claim 1, wherein the cleaning station is located at the 3 o'clock position in the electrophotographic machine.

3. The cleaning station as claimed in claim 2, wherein the cleaning seal is preferably 3 mils thick.

4. The cleaning station as claimed in claim 1, wherein the cleaning seal is between 2–5 mils thick.

5. The cleaning station as claimed in claim 1, wherein the second material is urethane.

6. A cleaning seal having a first end and a second end in a cleaning station which contacts a photoconductive member thereby sealing the cleaning station, comprising:

a first cleaning seal portion at the first end of the cleaning seal supplying sufficient force to support toner removed by the cleaning station;

a second cleaning seal portion which contacts the photoconductive member, the second cleaning seal portion being made of a softer material than the first cleaning seal portion, wherein the second cleaning seal portion extends 1–5 mm from the second end of the cleaning seal.

7. The cleaning seal as claimed in claim 6, wherein the first cleaning seal portion is 2–5 mil Mylar and the second cleaning seal portion is urethane.

8. A method of sealing a cleaning station of an electrophotographic machine having a photoconductive member, comprising:

locating a cleaning seal having a first end and a second end with a cleaning seal tip, which is relatively softer than the cleaning seal, in a sealing relationship between the cleaning housing and the photoconductive member, wherein the first end of the cleaning seal is attached to the cleaning housing and the cleaning seal tip extends 1–5 mm from the second end of the cleaning seal;

contacting the photoconductive member with the cleaning seal tip, wherein fewer scratches result on the photoconductive member than when the relatively soft cleaning seal tip is absent.

9. The method of sealing a cleaning station as claimed in claim 8, wherein locating the cleaning seal further comprises:

locating the cleaning seal after a cleaning blade has removed toner from the photoconductive member.

10. The method of sealing a cleaning station as claimed in claim 9, wherein locating the cleaning seal further comprises:

locating the cleaning seal substantially vertical with respect to the cleaning blade so that toner removed and falling past the cleaning blade is supported by the cleaning seal.

11. The method of sealing a cleaning station as claimed in claim 8, wherein the cleaning seal is made of a polyester material 2–5 mils thick.

12. The method of sealing a cleaning station as claimed in claim 8, wherein the cleaning seal tip is made of soft plastic.

13. The method of sealing a cleaning station as claimed in claim 12, wherein the cleaning seal tip is made of urethane.

* * * * *